US005815943A

United States Patent [19]

Puumalainen

[11] Patent Number: 5,815,943

[45] Date of Patent: Oct. 6, 1998

[54] METHOD AND ARRANGEMENT FOR UTILIZING ENERGY OF DRYING APPARATUS FOR FIBRE WEB

[75] Inventor: Jarmo Puumalainen, Tampere, Finland

[73] Assignee: Valmet Corporation, Helsinki, Finland

[21] Appl. No.: 832,729

[22] Filed: Apr. 11, 1997

[30] Foreign Application Priority Data

Apr. 12, 1996 [FI] Finland ..... 961639

[51] Int. Cl.[6] ..... F26B 13/26

[52] U.S. Cl. ..... 34/95; 34/392; 34/417; 34/624

[58] Field of Search ..... 34/65, 95, 624, 34/71, 242, 393, 392, 417, 418

[56] References Cited

U.S. PATENT DOCUMENTS

| | | | |
|---|---|---|---|
| 4,112,586 | 9/1978 | Lehtinen | 34/9 |
| 4,506,457 | 3/1985 | Lehtinen | 34/41 |
| 4,887,362 | 12/1989 | Rautakorpi et al. | 34/41 |
| 4,958,444 | 9/1990 | Rautakorpi et al. | 34/71 |
| 5,471,765 | 12/1995 | Rautakorpi et al. | 34/242 |
| 5,566,472 | 10/1996 | Lehtinen et al. | 34/242 |
| 5,706,587 | 1/1998 | Lehtinen et al. | 34/71 |
| 5,722,182 | 3/1998 | Lehtinen et al. | 34/418 |

FOREIGN PATENT DOCUMENTS

| | | |
|---|---|---|
| 59439 | 4/1981 | Finland . |
| 76856 | 8/1988 | Finland . |
| 92735 | 8/1994 | Finland . |
| 3151597 | 8/1982 | Germany . |

*Primary Examiner*—Henry A. Bennett
*Assistant Examiner*—Pamela A. Wilson
*Attorney, Agent, or Firm*—Ladas & Parry

[57] ABSTRACT

A method and an arrangement for utilizing energy of an apparatus for drying a fibre web. The drying apparatus comprises two endless bands (1, 2) that are impermeable to air and that have a good thermal conductivity. A fibre web (5) runs between the bands (1, 2) with at least one felt or wire (3, 4). The metal band in contact with the fibre web (5) is heated. Correspondingly, the metal band in contact with the felt is cooled with water contained in a water chamber (10). The cooling water used is conducted to a heat exchanger (25) that is used to heat water conducted to heat the process water in a papermaking or a board machine.

14 Claims, 2 Drawing Sheets

METHOD AND ARRANGEMENT FOR UTILIZING ENERGY OF DRYING APPARATUS FOR FIBRE WEB

Figure 1:
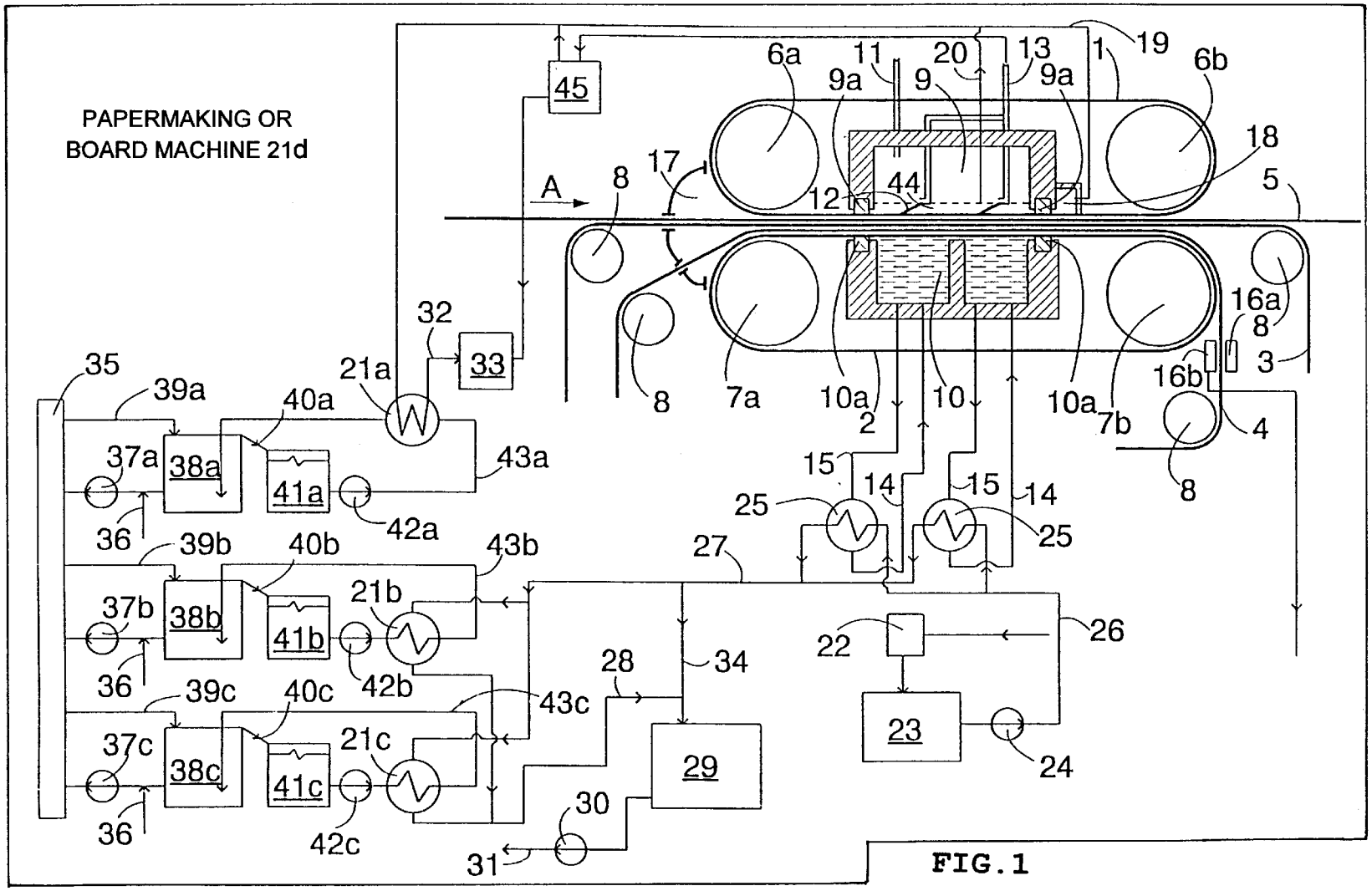

The invention relates to a method for utilizing energy of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, whereby the first band is heated and the second band is cooled with water, and the fibre web and at least one felt or wire run between the bands in such a way that the fibre web is in contact with the heated first band and the felt or wire is correspondingly situated between the fibre web and the cooled second band, the cooling water used being supplied via at least one heat exchanger back to cool the second band.

The invention also relates to an arrangement for utilizing energy of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, whereby the first band is heated, a water chamber being arranged to cool the second band, whereby the fibre web and at least one felt or wire run between the bands in such a way that the fibre web is in contact with the heated first band and the felt or wire is correspondingly situated between the fibre web and the cooled second band, the arrangement also comprising at least one heat exchanger and means for conducting the cooling water used back to the water chamber via the heat exchanger.

Finnish patent 59439 discloses a method and equipment where a fibre web is dried between two continuously moving metal bands in such a way that a fibre web runs between the bands together with a dryer felt, so that the metal band touching the web has been heated and the metal band touching the felt has correspondingly been cooled. In such a case, water contained in the web vaporizes under the influence of the hot metal band and passes to the felt due to the pressure of the steam, simultaneously pushing water in front of it, and the steam transferred to the felt condenses due to the effect of the cold cooled band, whereupon water passes from the web to the felt and the web is dried. The hot metal band is heated by means of a steam chamber. The steam chamber is sealed with seals against the metal band to be heated. The cooling takes place by means of a water chamber. The cooling water used is removed from the water chamber and conducted to a stripping column via a mixer. The stripping column provides steam for the steam chamber and cooled water for the water tank. However, the use of this system is only economic on a large scale when the prices of fossil fuels are rather high.

Finnish patent 76856 discloses a similar method and equipment for drying a fibre web. The reference also discloses that the cooling device is a hydrostatic plate comprising several pressure cavities and return ducts that are separated by necks. Some of the water from the return ducts to the pressure cavities can be circulated through a heat exchanger. However, the reference does not disclose any manner of utilizing energy obtained from the heat exchanger.

Finnish patent 92735 also discloses a similar method and equipment for drying a fibre web. The reference also discloses a steam recovery chamber provided in association with the seal at the end of the steam chamber where the metal bands come into sight from between the heating and the cooling chamber. The steam discharged from the steam chamber from between the seal and the heated band can be gathered to the steam recovery chamber. Since the discharged steam cannot escape into the atmosphere, noise problems and other problems brought about by the steam can be avoided. However, the aforementioned reference does not disclose any manner of utilizing the recovered steam.

In the above-described apparatuses for drying a fibre web, in practice the cooling water used is most often allowed to cool freely, so that the heat contained in the water is totally wasted. On the other hand, it is possible that the cooling water must be cooled specifically, so that the cooling wastes expensive energy. Further, preparing live steam and supplying it for use for example in the papermaking process requires very complicated and costly investments in equipment. The preparation of live steam is also expensive due to the high cost of energy required for producing live steam. At present, steam discharged for example from an apparatus for drying a fibre web escapes for example to a hood of a papermaking machine, but the heat recovery efficiency of this arrangement is low and the temperature level of the recovered energy is low.

The purpose of the present invention is to provide a method and an arrangement for utilizing high-temperature water and low-pressure steam that are obtained from an apparatus for drying a fibre web.

The method according to the invention is characterized in that the heat exchanger is used to heat water that is supplied to heat process water in a papermaking or a board machine.

Further, the arrangement according to the invention is characterized in that the heat exchanger is arranged to heat the water, and the arrangement comprises means for conducting the water to heat the process water in a papermaking or a board machine.

The essential idea of the invention is that energy required for heating process water in a board or a paper mill is obtained by heating the process water with water that is heated with a heat exchanger to which the cooling water used in a water chamber of an apparatus for drying a fibre web is conducted. Further, according to a preferred embodiment the process water is heated with a heat exchanger to which steam escaping from the pressure chamber of the apparatus for drying a fibre web is supplied. Also, the secondary steam from the condensate tank can be conducted to heat the process water.

The invention has the advantage that the heating of the process water does not require expensive live steam. Further, the thermal power of the drying apparatus can be recovered in full with the method according to the invention. In addition, rather warm water can also be heated.

Figure 2:
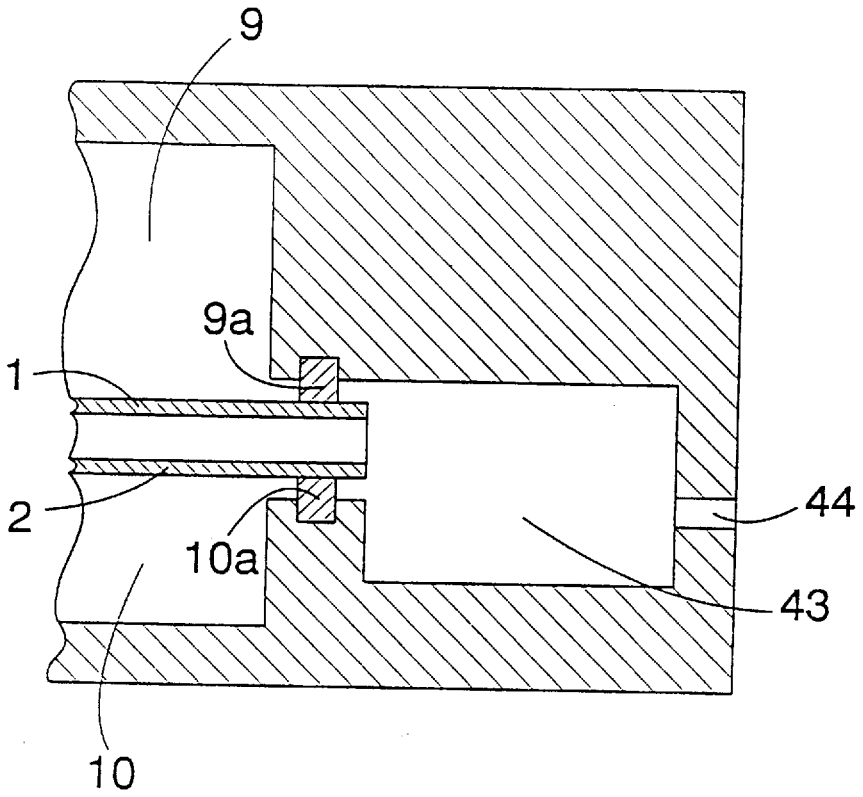

The invention will be described in greater detail in the accompanying drawings, in which FIG. 1 is a schematic side view, in cross-section, of an apparatus for drying a fibre web and of the application of the invention in association with the apparatus, and FIG. 2 is a schematic cross-section of the edge of an apparatus for drying a fibre web, made in the direction of travel of the fibre web.

FIG. 1 is a schematic side view of a drying apparatus according to the invention in a section made in the direction of travel of the web. The drying apparatus comprises an endless first band 1 or upper band and an endless second band 2 or lower band, which are impermeable to air and have a good thermal conductivity, being preferably made of metal. A fine wire or felt 3, a coarse wire 4 and a fibre web 5 move on between the band surfaces facing each other. The fibre web 5 moves in the direction shown by arrow A. The first band 1 is arranged to turn around first turning rolls 6*a* and 6*b* provided at the ends of the drying apparatus. Correspondingly, the second band 2 is arranged to turn around second turning rolls 7*a* and 7*b* also provided at the ends of the drying apparatus below the first turning rolls 6*a* and 6*b*. The wires 3 and 4 are supported and guided by guide rolls 8. Since the pressure at the drying zone in the space between the bands 1 and 2 is usually different from the pressure prevailing outside or on the sides of the bands 1 and 2, seals are provided on both sides of the apparatus between the bands 1 and 2 or near the edges thereof, to prevent liquid or gas from escaping sideways out of the space between the bands 1 and 2, or vice versa. For the steam heating required by the drying process, the drying apparatus comprises a pressure chamber 9 that is situated above the first band 1. The first band 1 is sealed with seals 9*a* to the pressure chamber 9 so that the steam in the pressure chamber 9 has a suitable pressure. Below the second band 2 there is a water chamber 10 containing water that cools the second band 2. The edges of the water chamber 10 are provided with seals 10*a* with which the second band 2 is sealed to the water chamber 10. The water chamber 10 of the apparatus shown in the figure is divided into two parts. The water chamber 10 may also consist of one part or it may contain several separate pressure cavities and return ducts.

The operation of the drying apparatus is based on heating the first band 1 in contact with the web 5 by hot steam contained in the pressure chamber 9, whereby water contained in the web 5 vaporizes due to the high temperature of the first band 1 and passes through the wires 3 and 4 towards the second band 2. The second band 2 is in turn cooled continuously by water arranged below it, whereby steam reaching the surface of the band will condense into water and is removed with the band 2 and the wire 4.

Saturated steam is supplied to the pressure chamber 9 via a pipe 11. In the pressure chamber 9, condensation water is collected from the surface of the band 1 with condensate recovery units 12. The condensate is discharged from the condensate recovery units 12 via discharge pipes 13. Water is supplied to the water chamber 10 via an inlet pipe 14. The cooling water used is discharged via a discharge pipe 15. Water is supplied to each part of the water chamber 10 along a separate inlet pipe 14 and the cooling water used is discharged from each part along a separate discharge pipe 15. If the water chamber 10 had more parts, corresponding numbers of inlet pipes 14 and discharge pipes 15 would naturally be used. The steam chambers may also contain several parts.

The wire 4 is provided with blow boxes 16*a* and suction boxes 16*b* with which humidity is removed from the wire 4. Water can be removed from the wire 4 by using either both the blow tanks 16*a* and the suction boxes 16*b* provided on opposite sides of the wire 4, or only one of these. The water recovered from the suction box 16*b* is conducted to a recovery tank, for example.

Before the fibre web 5 and the wires 3 and 4 run between the bands 1 and 2, they are supplied through an air exhaust unit 17 where air is removed from the pores of the web 5 and the wires 3 and 4 as carefully as possible for example by supplying superheated or saturated steam having a suitable temperature through them, the steam pushing the air molecules out of the pores and replacing them with water molecules of the steam.

There is a steam recovery chamber 18 in association with the pressure chamber 9 at the end where the bands 1 and 2 come into sight from between the pressure chamber 9 and the water chamber 10. The steam that escapes from the pressure chamber 9 from between the seal 9*a* and the heated band 1 can be collected to the steam recovery chamber 18. In a corresponding manner, condensate that flows out from between the seal 9*a* and the heated band 1 can be collected to the steam recovery chamber 18. Majority of the condensate vaporizes in the steam recovery chamber 18 under the influence of the heated band 1.

Also the sides of the pressure chamber 9 may comprise similar steam recovery chambers, i.e. side chambers 44, where it is possible to collect steam and condensate that escape sideways from between the seal 9*a* and the heated band 1 and water that flows from between the cooled band 2 and the edge seal 10*a* of the water chamber. Extra steam can be removed from the side chamber 44 via a discharge pipe 20. The side chamber 44 is denoted schematically with broken lines in FIG. 1. The steam obtained from the steam recovery chamber 18 and steam and other similar leakage and waste vapour obtained along the pipe 20, for example, can be conducted along a pipe 19 for reuse in the manner shown in the accompanying figure. With the pipe 19 the steam is conducted to a heat exchanger 21*a*. In the heat exchanger 21*a* the steam is converted into condensate that is supplied along a pipe 32 to a second condensate tank 33. The heat exchanger 21*a* heats for example process water of a papermaking or board machine 21*d* in a manner disclosed in greater detail below.

The condensate collected with the condensate recovery units 12 is supplied along the discharge pipes 13 to a first condensate tank 45. Since the pressure of the condensate decreases in the first condensate tank 45, secondary steam is produced and it can be conducted along the pipe 19 to the heat exchanger 21*a*. The condensate can be supplied from the first condensate tank 45 to the second condensate tank 33, for example.

The cooling water that has been used, or heated, is transferred at least partly from the water chamber 10 to a heat exchanger 25 along the discharge pipe 15. From the heat exchanger 25 the water that has been cooled there is supplied back to the water chamber 10 via the inlet pipe 14. The cooling water used is conducted from each part of the water chamber 10 to a separate heat exchanger 25. Therefore, there are one or two or alternatively several heat exchangers, depending on how many parts the water chamber 10 is divided into.

The heat exchanger 25 heats water supplied from a first hot water tank 23 with a pump 24 via a pipe 26. Water can be supplied to the first hot water tank 23 for example from suction pumps of a board machine via a sealing water pipe or the water may be cold water taken from the raw water network, but it is also possible to use some other water stream that is sufficiently large and that requires heating. The water supplied to the first hot water tank 23 can be heated, if required, for example in a heat recovery unit 22, so that the temperature of the water in the first hot water tank 23 is typically about 40° to 50° C., i.e. the water may be relatively warm already at this stage. The temperature of the water may also be between 5° and 60° C. The water is supplied from the heat exchanger 25 via a pipe 27 to a heat exchanger 21*b* and 21*c*. The water contained in the pipe 27 can be heated under suitable circumstances with the heat exchanger 25 to about 80° C., for example. Process water of a board machine, for example, is heated with the heat exchangers 21*b* and 21*c* in a manner described below. The water is supplied from the heat exchangers 21*b* and 21*c* along a pipe 28 to a second hot water tank 29. The temperature of the water in the pipe 28 after the heat exchangers 21*b* and 21*c* may be about 60° to 70° C., for example, if the temperature of the water before the heat exchangers 21*b* and 21*c* was for example about 80° C. Lower temperatures are also possible if a great deal of energy is transferred to the heat exchangers 21*b* and 21*c*. Water can be supplied from the second hot water tank 29 with a pump 30 and a pipe 31 for use as spray water in a papermaking or a board machine, for example, i.e. to be used for washing wires or felts, among other things. The arrangement according to the invention also provides efficient and advantageous heating of spray water.

If the temperature of the water in the pipe 27 after the heat exchangers 25 is not so high that it would be economically wise to circulate the water via the heat exchangers 21*b* and 21*c*, the water can be guided directly to the hot water tank 29 via a pipe 34. For the sake of clarity, the sensors, control and regulation means and valves that are required for carrying out this guidance and that are known per se are not shown in the accompanying figure.

The pipe 27 can also be connected to the heat exchanger 21*a*. In such a case, if no additional or discharged steam is obtained from the pressure chamber 9 along the pipe 19, water can be supplied to the heat exchanger 21*a* from the pipe 27. The connection from the pipe 27 to the heat exchanger 21*a* is not shown in the accompanying figure for the sake of clarity.

The figure also shows a head box 35 of a board machine. A mixture of a thick mass 36 and water is supplied to the head box with pumps 37*a* to 37*c*. Since the head box is situated in a board machine, the mass 36 can be supplied separately for example for the surface, the frame and the background. These supply arrangements and the related circulation arrangements for process water are in principle similar. There are one, two or several supply and process water arrangements depending on whether the machine is a papermaking or a board machine and on what kind of paper or board is manufactured with the machine. In the board machine set forth herein there are two arrangements. Water from first white water tanks 38*a* to 38*c* is mixed with the thick mass 36. Water is returned from the head box 35 to the white water tanks 38*a* to 38*c* via return ducts 39*a* to 39*c*. Overflow is arranged from the first white water tanks 38*a* to 38*c* such that water passes from the first white water tanks 38*a* to 38*c* via overflow pipes 40*a* to 40*c* to second white water tanks 41*a* to 41*c*. Water is circulated from the second white water tanks 41*a* to 41*c* along pipes 43*a* to 43*c* by means of pumps 42*a* to 42*c*. The pipes 43*a* to 43*c* are conducted via the heat exchangers 21*a* to 21*c* so that the water contained in the pipes 43*a* to 43*c* is warmed in the heat exchangers 21*a* to 21*c*. The heated water is returned to the first white water tank 38*a* to 38*c*. The water is preferably returned to the bottom or the middle section of the white water tanks 38*a* to 38*c* so that the heated water is mixed with the cooler water contained in the first white water tank 38*a* to 38*c*. Cooler water can be discharged from the first white water tanks 38*a* to 38*c* via the overflow pipe 40*a* to 40*c* to the second white water tanks 41*a* to 41*c* to be further heated with the heat exchangers 21*a* to 21*c*. Such indirect heating of the water contained in the first white water tanks does not cause too many additional flows in the first white water tanks 38*a* to 38*c*.

FIG. 2 is a schematic cross-section of the edge of an apparatus for drying a fibre web, made in the direction of travel of the fibre web. It is possible to collect in the side chamber 44 steam and condensate that escape from between the seals 9*a* of the pressure chamber 9 and the first band 1 and water that leaks from between the seals 10*a* of the water chamber 10 and the second band 2. The steam, water and condensate are supplied along one or more pipes 46 first to a collector basin and from there for use. For the sake of clarity, this arrangement is not shown in the accompanying figures. According to the invention, the steam recovered via the side chambers 44 is conducted for use along the discharge pipe 20, as shown in FIG. 1. Also for the sake of clarity, FIG. 2 does not show the wires 3 and 4 or the fibre web 5.

The drawings and the related description are only intended to illustrate the inventive idea. The details of the invention may vary within the scope of the claims.

I claim:

1. A method for utilizing energy of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, whereby the first band is heated and the second band is cooled with water, and the fibre web and at least one felt or wire run between the bands such that the fibre web is in contact with the heated first band and the felt or wire is correspondingly situated between the fibre web and the cooled second band, the cooling water used being supplied via at least one heat exchanger back to cool the second band, wherein the heat exchanger is used to heat water that is supplied to heat process water in a papermaking or a board machine.

2. A method according to claim 1, wherein the second band is cooled with a water chamber comprising several separate parts, the cooling water used being circulated via a separate heat exchanger and returned back, the water heating the process water being heated with several heat exchangers.

3. A method according to claim 1, wherein the first band is heated with a pressure chamber containing a pressure medium that is steam, and steam that escapes from the pressure chamber is discharged and conducted to a heat exchanger that heats the process water in a papermaking or a board machine.

4. A method according to claim 3, wherein the pressure chamber is sealed against the first band with at least one seal and the pressure chamber is provided with an associated steam recovery chamber where the steam that escapes from between the seal and the first band can be collected, the steam collected to the steam recovery chamber being conducted to the heat exchanger.

5. A method according to claim 4, wherein the drying apparatus is provided with an associated side chamber where the steam that escapes from between the seal and the first band can be collected, the steam collected to the side chamber being conducted to the heat exchanger.

6. A method according to claim 1, wherein condensation water is collected from the surface of the first band and the water is supplied to a first condensate tank, secondary steam obtained from the tank being conducted to the heat exchanger.

7. A method according to claim 1, wherein the water heating the process water is used as spray water in a papermaking or a board machine after the heating of the process water.

8. An arrangement for utilizing energy of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, whereby the first band is heated, a water chamber being arranged to cool the second band, whereby the fibre web and at least one felt or wire run between the bands in such a way that the fibre web is in contact with the heated first band and the felt or wire is correspondingly situated between the fibre web and the cooled second band, the arrangement also comprising at least one heat exchanger and means for conducting the cooling water used back to the water chamber via the heat exchanger, which is arranged to heat the water, the arrangement further comprising means for conducting the water to heat the process water in a papermaking or a board machine.

9. An arrangement according to claim 8, wherein the water chamber consists of several separate parts, the arrangement comprising means for circulating the cooling water used via a separate heat exchanger and for returning the water back, the water heating the process water being heated with several heat exchangers.

10. An arrangement according to claim 8, wherein a pressure chamber containing a pressure medium that is steam is arranged to heat the first band, the arrangement further comprising means for discharging the additional steam contained in the pressure chamber, and a heat exchanger and means for conducting the steam discharged from the pressure chamber to the heat exchanger, the heat exchanger being used to heat the process water in a papermaking or a board machine.

11. An arrangement according to claim 10, wherein the pressure chamber is sealed against the first band with at least one seal, and the pressure chamber is provided with an associated steam recovery chamber where steam that escapes from between the seal and the first band can be collected, the arrangement further comprising means for conducting the steam collected in the steam recovery chamber to the heat exchanger.

12. An arrangement according to claim 11, wherein the drying apparatus is provided with an associated side chamber where steam that escapes from between the seal and the first band can be collected, the arrangement further comprising means for conducting the steam collected in the side chamber to the heat exchanger.

13. An arrangement according to claim 8, the arrangement further comprising condensate recovery units for collecting condensate from the surface of the band and means for conducting the condensate to a first condensate tank and means for conducting the secondary steam from the condensate tank to the heat exchanger.

14. An arrangement according to claim 8, the arrangement further comprising means for conducting the water heating the process water for use as spray water in a papermaking or a board machine after the heating of the process water.

* * * * *